US008492989B2

(12) United States Patent
De Smit

(10) Patent No.: US 8,492,989 B2
(45) Date of Patent: Jul. 23, 2013

(54) SWITCHED-MODE POWER SUPPLY, LED LIGHTING SYSTEM AND DRIVER COMPRISING THE SAME, AND METHOD FOR ELECTRICALLY DRIVING A LOAD

(75) Inventor: Pedro De Smit, Geertruidenberg (NL)

(73) Assignee: Lioris B.V., Raamsdonk (NL)

( * ) Notice: Subject to any disclaimer, the term of this patent is extended or adjusted under 35 U.S.C. 154(b) by 324 days.

(21) Appl. No.: 12/992,567

(22) PCT Filed: May 14, 2009

(86) PCT No.: PCT/EP2009/055874
§ 371 (c)(1),
(2), (4) Date: Feb. 7, 2011

(87) PCT Pub. No.: WO2009/138478
PCT Pub. Date: Nov. 19, 2009

(65) Prior Publication Data

US 2011/0115403 A1 May 19, 2011

(30) Foreign Application Priority Data

May 14, 2008 (WO) ..... PCT/EP2008/003842

(51) Int. Cl.
*H05B 41/16* (2006.01)

(52) U.S. Cl.
USPC ..... 315/247; 315/291; 315/297; 315/307; 315/224; 315/360; 323/271; 323/282; 323/288; 323/224; 323/277; 363/80; 363/82; 363/89

(58) Field of Classification Search
USPC ..... 315/193, 224, 227 R, 282, 297, 307, 315/308, 312, 360, 362, 291, 247; 323/222, 323/224, 266, 282, 284, 288, 271, 277, 290; 363/80–82, 89
See application file for complete search history.

(56) References Cited

U.S. PATENT DOCUMENTS

| | | | | |
|---|---|---|---|---|
| 4,488,057 | A * | 12/1984 | Clarke | 307/66 |
| 5,642,267 | A * | 6/1997 | Brkovic et al. | 363/16 |
| 7,750,616 | B2 * | 7/2010 | Liu | 323/285 |
| 7,952,294 | B2 * | 5/2011 | Shteynberg et al. | 315/224 |
| 2008/0018261 | A1 | 1/2008 | Kastner | |
| 2008/0316781 | A1 | 12/2008 | Liu | |

FOREIGN PATENT DOCUMENTS

| | | |
|---|---|---|
| DE | 10119491 | 7/2002 |
| JP | 2007103232 | 4/2007 |
| WO | 2009055821 | 4/2009 |

* cited by examiner

*Primary Examiner* — Haiss Philogene
(74) *Attorney, Agent, or Firm* — Bozicevic, Field & Francis LLP; Bret E. Field

(57) ABSTRACT

The present invention is related to a switched-mode power supply. It is also related to a LED lighting system and driver which comprise such a switched-mode power supply. In addition, the present invention is related to a method for electrically driving a load. According to the present invention, the switched-mode power supply is switched from a charging state, in which an energy storage is charged, to a discharging state, in which the energy storage feeds a load, when a current limit has been exceeded. This current limit is set proportional to an instantaneous voltage outputted by the rectifier.

25 Claims, 12 Drawing Sheets

SWITCHED-MODE POWER SUPPLY, LED LIGHTING SYSTEM AND DRIVER COMPRISING THE SAME, AND METHOD FOR ELECTRICALLY DRIVING A LOAD

FIELD OF THE INVENTION

The present invention is related to a switched-mode power supply. It is also related to a LED lighting system and driver which comprise such a switched-mode power supply. In addition, the present invention is related to a method for electrically driving a load.

BACKGROUND OF THE INVENTION

Switched-mode power supplies are known in the art. These devices can be used to transform an alternating signal from a mains network, e.g. 230V at 50 Hz, into a DC or AC signal with different amplitude. The switched-mode power supply of the present invention is mainly directed towards transforming an alternating electrical supply signal into a DC signal, wherein the DC signal is used to feed a load.

A switched-mode power supply typically comprises a rectifier which is arranged to convert an electrical supply signal provided at its input, e.g. from a mains network, into a rectified electrical supply signal emerging at its output. It also contains an energy storage for storing electrical energy. This energy storage can be connected to the load to be fed. In this storage, electric field energy and or magnetic field energy, or electromagnetic energy in general, can be stored.

Furthermore, the supply comprises a controllable switching element that is connected to the energy storage. The switching element is arranged to switch the switched-mode power supply between a charging state, in which the energy storage is charged by the rectifier via charge transport from the rectifier, and a discharging state, in which the energy storage releases at least part of electrical energy stored therein to the load. Charge transport, such as current flow, results in build-up of energy in the energy storage. For instance, current through an inductor gives rise to a magnetic field. The energy associated with this field can be regained if the inductor is subjected to a negative current change.

A switching element controller is used for controlling the switching element. It is arranged to control the switching element to switch the switched-mode power supply from the charging state to the discharging state when the charge transport exceeds a current limit.

During operation, the switched-mode power supply alternates between the charging state and discharging state at a switching frequency which is substantially higher than a frequency of the rectified electrical supply signal. As such, in a period of the rectified electrical supply signal, the switched-mode power supply changes states multiple times. Typically, the switching frequency of the supply is in the order of 10 kHz-10 MHz, compared to a frequency of roughly 100-120 Hz for the rectified supply signal.

Recently, LED-based lighting solutions have emerged on the market that can compete with the traditional incandescent or fluorescent lighting. LED-based lighting is more energy efficient and has a longer service life than traditional lighting products.

LED-based lighting typically comprises a plurality of LEDs which are controlled by a LED driver. Most often, the LED driver itself comprises a switched-mode power supply. Especially for domestic lighting solutions, the LED driver can normally be connected to the mains, e.g. 110V or 230V, of the home electricity network.

A typical circuit configuration of a known LED-based lighting device is schematically illustrated in FIG. 1A. The device comprises a LED driver 1 driving a plurality of LEDs, LED-1 . . . LED-X. The driver comprises a rectifier 2 which performs a full-wave rectification on an alternating electrical supply signal at its input terminals 3, 3', e.g 230V @ 50 Hz. The rectified signal is fed to LED-1 . . . LED-X through switching element 4, which causes a time-varying current through LED-1 . . . LED-X. The frequency of the time-varying LED current, which corresponds to the switching frequency, is substantially higher than the frequency of the rectified electrical supply signal.

The switched-mode operation of the LEDs improves the power efficiency compared to the situation in which the LEDs are connected to the rectifier directly albeit using a resistor connected in series to limit the current.

A problem with these known LED-based lighting devices, or LED drivers, is the low power factor and high harmonic distortion that is commonly associated with highly non-linear devices.

A low power factor indicates that a significant amount of the power delivered to the LED lighting system is reactive. Reactive power presents a challenge for the energy suppliers in that it does not contribute to the power dissipated/used by the consumer but it does increase the load on the electricity network due to high currents and/or voltages which can occur in them.

Another problem related to non-linear electronic devices is harmonic distortion which introduces unwanted high frequency components in the network. These signals could interfere with other components connected to the network.

Typical I-V characteristics of a known LED-based lighting device are illustrated in FIG. 1B. As shown, the current is only drawn from the mains network when the applied voltage is high. In addition, the current waveform is non-sinusoidal and out of phase compared to the applied voltage. As a result of these factors, the power factor is low and the harmonic distortion high.

It is therefore an object to provide a switched-mode power supply capable of operating with a high power factor in which the above mentioned disadvantages do not occur, or at least in a lesser degree.

SUMMARY OF THE INVENTION

This object is achieved with the switched-mode power supply according to the present invention. According to the invention, the current limit is set proportional to an instantaneous voltage of the rectified electrical supply signal.

The current drawn from the rectifier varies at a significantly higher frequency than the voltage outputted by the rectifier. In a small enough time span, the voltage can be considered constant, whereas the current is subject to variation, e.g. during this time span the switched-mode power supply will change states a plurality of times. During the charging state of the switched-mode power supply, the current is kept within a current limit proportional to an instantaneous voltage of the rectified electrical supply signal. Consequently, during the above mentioned time span, the average current that is drawn is substantially proportional to the outputted voltage resulting in the desired high power factor.

The current limit is related to the charge transport from the rectifier. In an advantageous embodiment of the present invention, the current limit corresponds to the maximum current during the duration of the charging state. In this case, the switched-mode power supply switches to the discharging state if the current delivered by the rectifier exceeds a maximum value which is proportional to the instantaneous voltage outputted by the rectifier.

In another advantageous embodiment of the present invention the average current during the duration of the charging state is used as current limit. In this case, not the maximum value but the average value computed over the duration of the charging state is used as current limit. Typically, current flow will gradually increase after a switch to the charging state. As a consequence, the required average will only be achieved after a certain amount of time during the charging state.

In another advantageous embodiment of the present invention, the current limit corresponds to the average current during the combined duration of the charging state and discharge state. In this case the average current is computed over the combined duration of the charging and discharging state. Consequently, at the output of the rectifier a certain average current is delivered to the remainder of the circuit that is proportional to the instantaneous voltage. Effectively, a high power factor is obtained.

When using an average current determination as described for two embodiments above, the non-linearity of the load to be driven is of less importance than working with maximum currents. With linear loads a correlation can be found between the average current and the maximum current during a charging state, the proportionality constant depending on the shape of the current-time curve. A problem with non-linear loads is that the shape of this curve might change significantly with the instantaneous voltage outputted by the rectifier. Using a current average instead of a current maximum obviates this problem. Still, using a maximum current as current limit enables a very simple solution to be used which for most cases offers a satisfactory solution. If the switched-mode power supply is used for driving LEDs, the non-linear behavior will be most dominant at low currents and or voltages. At higher values, the series resistance of the LEDs will be more visible. However, the high power part of the operation, in which the devices become more linear, has the largest influence on the power factor. This makes that high power factors are achievable by using maximum current limits.

To determine the average current, the switching element controller could comprise a timer to determine a relevant duration, e.g. the duration of the charging state and or the discharging state. Furthermore, the switching element controller is preferably arranged to measure a current corresponding to the charge transport and to determine the average current by integrating the measured current over time and by dividing the integrated current by the relevant duration.

In case an average current is determined for the combined duration of the charging and discharging state, it may be possible to first determine the duration of a discharging state and then to determine the duration of a subsequent charging state and to add these two values. In case the duration of the various states is not fixed in a predetermined fashion, this sequence enables an average to be determined while the switched-mode power supply is in the charging state.

The average current seen from a perspective of the rectifier can also be influenced by the duration of the discharging state. Normally, the rectifier does not supply a substantial current during this period, as a result of which the average current seen by the rectifier is lower than the average current during the charging period. If the combined duration of the charging and discharging state is kept constant or at least at a predetermined and or known value, the average current is related to the average current during the charging state by a constant factor.

In another or further embodiment of the present invention, the duration of the discharging state is predetermined and or known. This allows an average to be determined while the switched-mode power supply is in a charging state.

During the discharging state, the load is preferably solely fed by the release of electrical energy from the energy storage. In addition, the load is preferably at least partly fed by the rectifier during the charging state. Furthermore, the charge transport from the rectifier is preferably limited to the charging state.

BRIEF DESCRIPTION OF THE DRAWINGS

Next, the present invention will be described in more detail under reference to the accompanied drawings, in which.

DETAILED DESCRIPTION OF THE PREFERRED EMBODIMENTS

Figure 1A:
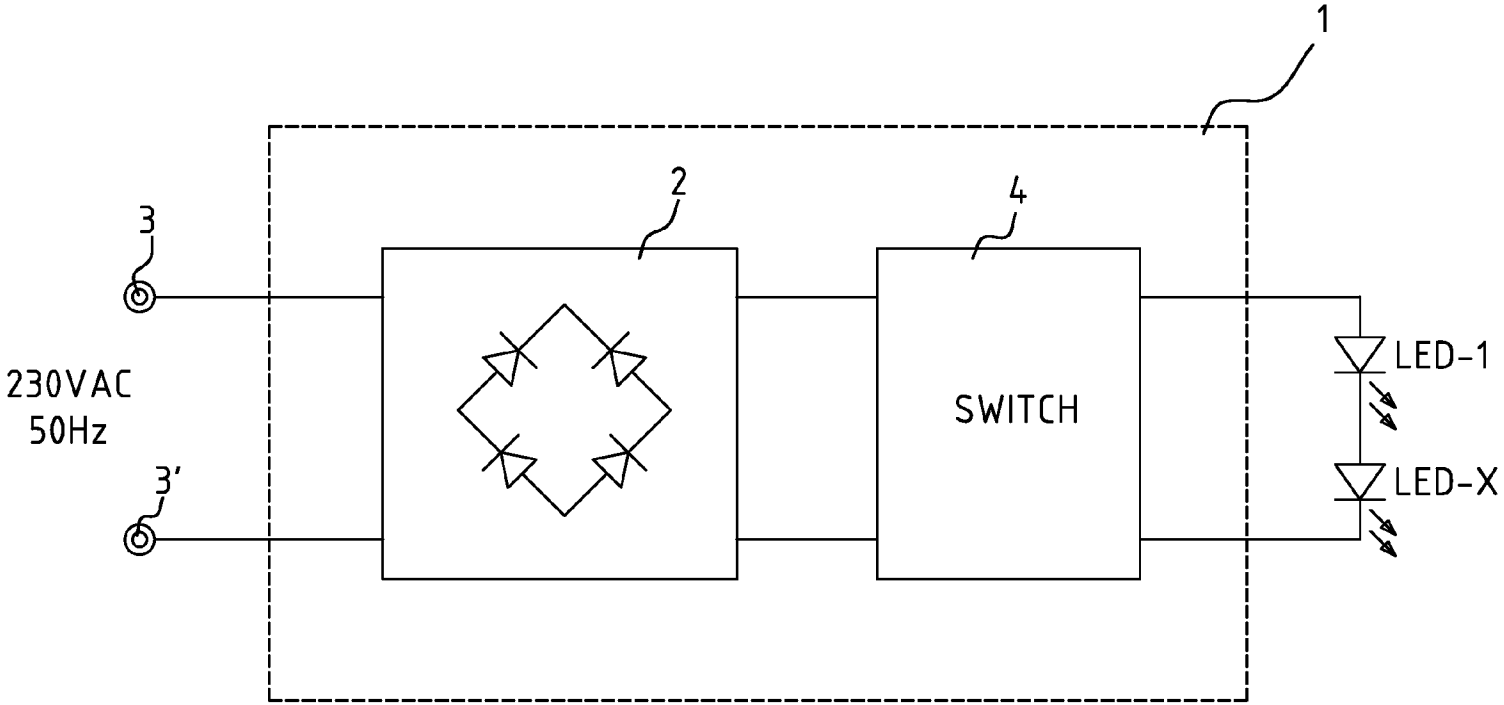
FIG. 1A Prior Art
FIG. 1A and 1B present a schematic illustration of a known LED lighting system, and typical I-V characteristics of such a system.
Figure 1B:
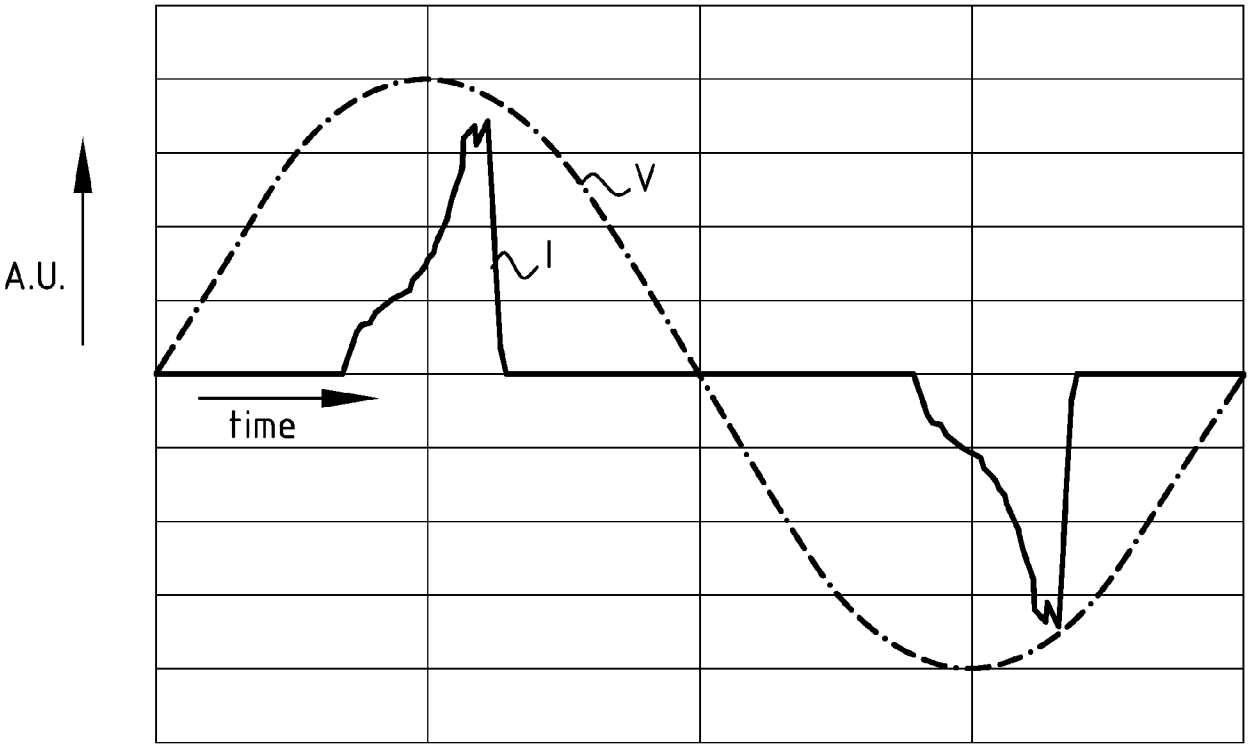
FIG. 1B Prior Art
Figure 2:
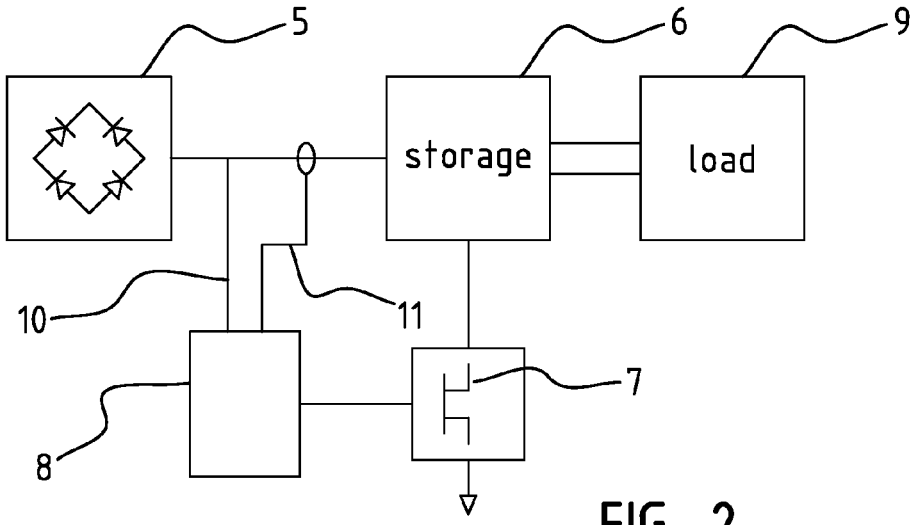
FIG. 2 illustrates an embodiment demonstrating the general principle of the present invention.

FIG. 2 illustrates a schematic embodiment demonstrating the general concept of the present invention described so far. The switched-mode power supply in FIG. 2 comprises a rectifier 5, an energy storage 6 connected or connectable to a load 9, a switching element in the form of a transistor 7, and a switching element controller 8. Transistor 7 is arranged such that any charge transport from rectifier 5 during at least the charging state will also flow through this transistor. It should be obvious to the skilled person that other arrangements of the switching element are possible, even arrangements not including a transistor per se. An important aspect of the switching element is the ability to switch the switched-mode power supply between the different states.

Switching element 7 is controlled by switching element controller 8. This controller receives a voltage 10 proportional to the rectified voltage at the output of rectifier 5, and a current 11 corresponding to the charge transport from rectifier 5 to the energy storage 6 during the charging state.

In the charging state, rectifier 5 delivers a time varying current to energy storage 6. Preferably, at least part of this current will also flow to load 9. When the current from rectifier 5 reaches a current limit, controller 8 will shut off transistor 7 thereby prohibiting any further current flow through this transistor and, in this case due to the arrangement of the transistor, from the rectifier. After this switch to the discharging state, energy storage 6 will release at least part of its stored energy to load 9. During this time, rectifier 5 will not deliver substantial current to energy storage 6.

Figure 3A:
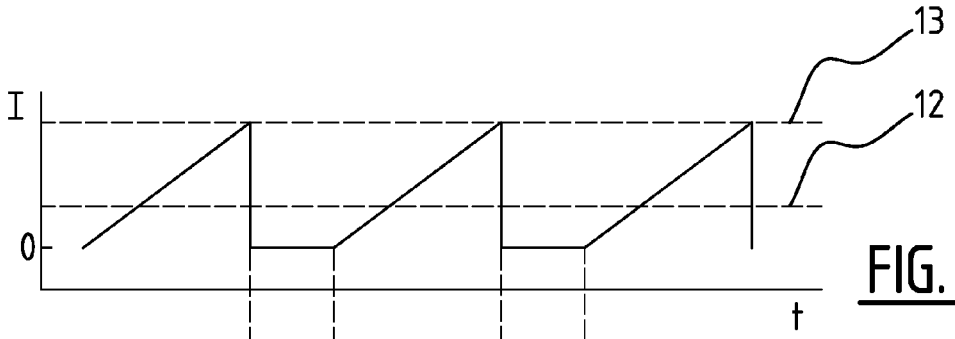
FIGS. 3A and 3B show possible waveforms corresponding to the embodiment in FIG. 2.
Figure 3B:
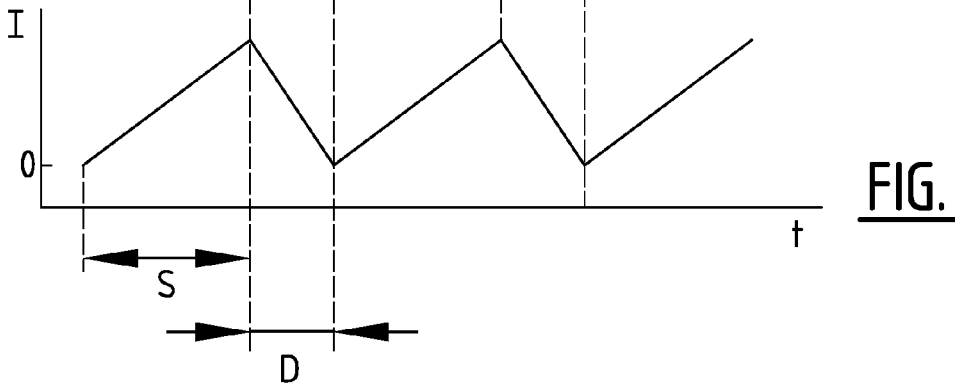

FIGS. 3A and 3B illustrate the current characteristics versus time for the current drawn from the rectifier and the current through the load, respectively. During the charging state, the current drawn from the rectifier, which flows to energy storage 6 and load 9, increases linearly. During the discharging state, energy storage 6 releases its energy by providing a linearly decreasing current to load 9. The average current drawn from rectifier 5, when determined for the combined duration of the discharging state (D) and charging state (S), indicated by line 12, is proportional to the maximum current as indicated by line 13. Assuming that the triangular shape is independent of the instantaneous voltage at the output of rectifier 5, an average current is drawn from the rectifier that is proportional to the outputted (instantaneous) voltage. It should be obvious to the skilled person that the particular current characteristics depend on components used. A linear increasing current for instance would correspond to an inductor as energy storage element.

In the example above, the duration of the charging and discharging states is constant. Furthermore, the triangular shape of the current was assumed to be independent of the voltage outputted by the rectifier. Consequently, both a current limit corresponding to the maximum current and a current limit corresponding to the average current during the charging state will provide a system with a strongly improved high power factor.

Figure 4:
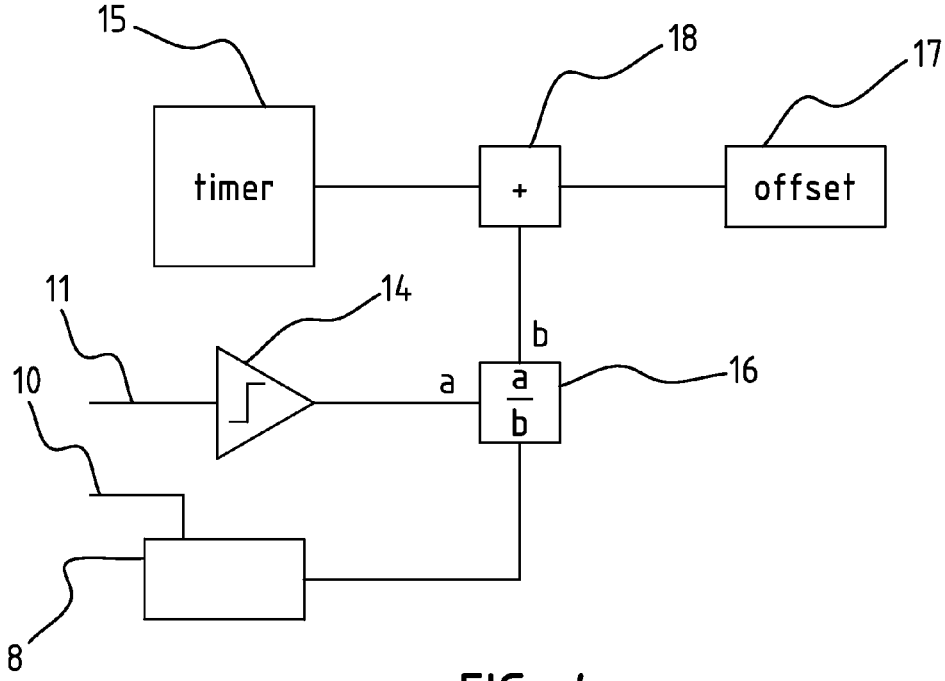
FIG. 4 depicts a further development of the embodiment in FIG. 2.

FIG. 4 illustrates an alternative embodiment demonstrating the general concept in which only the aspects different from FIG. 2 are illustrated. In FIG. 4, the measured current is fed to an integrator 14. Additionally, a timer 15 is included which is started directly after a switch from the discharging state to the charging state. The output of integrator 14 is fed to divider 16 which divides the integrated current with the timer value. This will yield the average current during that charging period. This value is fed back to switching element controller 8. The advantage of this circuit is that it is less susceptible to non-linearity of the load which could for instance alter the triangular shape in FIGS. 3A and 3B.

Additionally, an offset 17 may be introduced using an add block 18 that corresponds to the duration of the discharging state which is predetermined and or known. This value could relate to the discharging period following the current charging period or it could relate to a previous discharging period or to both. Alternatively, timer 15 could be disregarded if the offset comprises the combined duration of the charging and discharging states, for instance because this duration has a fixed and or known value.

In a preferred embodiment, the switched-mode power supply comprises a voltage meter for measuring a voltage proportional to an instantaneous voltage outputted by the rectifier, and a charge transport meter for measuring the charge transport. It further comprises a comparator for comparing the measured charge transport to the current limit, wherein the comparator is further arranged for outputting a comparison signal indicative for whether the current limit has been exceeded or not. In this case, the switching element is controllable in dependence of the comparison signal.

As stated before, it is preferred to arrange the switching element such that during the charging state, charge transport from the rectifier is through the switching element. It is advantageous if the voltage meter comprises a resistive voltage divider connected to the output of the rectifier, and if the charge transport meter comprises a resistor connected in series with the switching element. In this case, the charge transport meter is arranged to determine a voltage drop over the resistor. This configuration allows control over the current flow from the rectifier and it offers a relatively simple way of obtaining charge transport information. Typically, the switching element is a FET transistor with its source connected to ground via a small resistor. This same resistor is then used for determining the current through the transistor, which for the arrangement mentioned above corresponds to the current drawn from the rectifier.

After the switch from the charging state to the discharging state, the current drawn from the rectifier, and if applicable, through the switching element, sharply drops. Hence, the charge transport meter cannot solely function to determine when to switch back to the charging state. According to an embodiment of the invention, the switched-mode power supply further comprises holding means, preferably arranged in between the comparator and switching element, for holding a value of the comparison signal, preferably for a predetermined amount of time, after detection of exceeding the current limit. In this way, the energy storage is able to release its energy before another charging cycle begins.

The timing of the charging and or discharging state can be provided if the switched-mode power supply comprises an oscillator outputting an oscillation signal having a frequency substantially higher than a frequency of the rectified electrical supply signal, wherein the switching element is arranged to switch the switched-mode power supply to the charging state in dependence of the oscillation signal.

In a further embodiment, the switching element is controllable to switch the switched-mode power supply to the charging state in dependence of both the held value of the comparison signal and the oscillation signal. According to an embodiment, the charging state is initiated if the oscillator outputs a logical high value and if the held value is also high. This latter value corresponds to the situation where the measured current is low, which applies for the discharging state.

Using an oscillator further allows the combined duration of the charging state and discharging state to be determined.

Any unwanted high frequency components can be filtered out using filtering means connected to the rectifier output. This prevents the injection of high frequency components back into the mains network for instance via the output of the rectifier.

In a preferred embodiment of the present invention, the energy storage comprises an inductor, although capacitive elements could also be used. This inductor may be placed in between the rectifier and the switching element, wherein the load is connectable in series with the inductor.

Additionally, a fly-back diode may be connected in parallel to the series connection of load and inductor, or energy storage in general. The fly-back diode is arranged such that it conducts during the discharging state, in which it facilitates the release of energy from the energy storage to the load. It blocks during the charging state, forcing current to run through the energy storage and load, and if applicable, through the switching element.

In another preferred embodiment, the energy storage comprises a primary coil of a transformer. In this case the load is connectable to a secondary coil of the transformer. This configuration corresponds to a flyback transformer topology.

As mentioned above, the switching element may comprise a transistor. This transistor will from now on be referenced to as the first transistor. Under working conditions, this first transistor preferably has an "off" state in which it blocks current, and an "on" state in which it is conducting. These states correspond to the aforementioned discharging state and charging state, respectively.

The switched-mode power supply is particularly well suited for driving LEDs due to its ability to cope with high non-linear devices. Accordingly, the present invention provides a LED lighting system comprising a light-emitting diode (LED) and a LED driver to electrically drive the LED, wherein the LED driver comprises the switched-mode power supply as defined before.

In an embodiment of this LED lighting system, the energy storage, e.g. an inductor, is connected in series with the LED, wherein the series connection of energy storage and LED has a first node, for instance closest to the anode of the LED, and a second node, for instance closest to the cathode of the LED. The LED driver further comprises a fly-back diode placed parallel to the series connection of energy storage and LED, wherein the fly-back diode has its cathode connected to the first node and its anode connected to the second node. In this configuration, the second node is connected to the switching element.

In an alternative embodiment of the LED lighting system of the present invention, the energy storage is connected in series with the LED, wherein the series connection of energy storage and LED has a first node closest to the anode of the LED and a second node closest to the cathode of the LED. The LED driver further comprises a second transistor placed parallel to the series connection of energy storage and LED, wherein the second transistor is controllable by the switching element controller through an inverter such that the first and the second transistor operate in opposite states, and wherein the second node is connected to the first transistor.

To enhance the efficiency of the LED driver, and hence the LED lighting system, in the "off" state, which is predominantly determined by the on-voltage of the fly-back diode, the fly-back diode can be replaced by a second transistor. This transistor is controllable by said switching element controller, e.g. a transistor driver, preferably through an inverter, such that said first and said second transistor operate in opposite states. Hence, when the first transistor is in the "off" state, the current flows from the inductance through the LEDs and the second transistor, which in this case is in the "on" state.

Dimming of LED-based lighting systems which is typically triac based, is difficult due to the relatively low powers that are needed by these systems. Usually, these powers are too low to enable appropriate dimming. This problem can be circumvented using a further or alternative embodiment of the LED lighting system of the present invention which comprises a third transistor connected to the output of the rectifier. This transistor is placed in series with a resistive load and is controllable by the switching element controller, wherein the third transistor and switching element controller are arranged to provide an internal resistive loading during the charging and or discharging state. The loading prevents a triac from extinguishing prematurely. If the duration of either state is much shorter than the other state, the resistive loading can be chosen to occur only during a limited amount of time. By choosing appropriate values for the resistor, appropriate dimming can therefore be realized with low energy loss.

The present invention also provides an electronic LED driver for use in a lighting system, wherein the LED driver is arranged as defined above.

Furthermore, the present invention provides a method for electrically driving a load. It comprises the steps of providing an energy storage for storing electrical energy, providing a source of rectified electrical supply signal, and connecting the load to the energy storage. Driving the load is performed by first charging the energy storage from the source of rectified electrical supply signal via charge transport from this source. Subsequently, the charge transport is measured and compared to a current limit. If the current limit is being exceeded, a switch is made from the charging of the energy storage to releasing of stored electrical energy in the energy storage to the load. Then, another switch is made from the releasing of stored electrical energy to the aforementioned charging. These steps are repeated which results in an alternating behaviour of charging and discharging with a corresponding frequency which is substantially higher than a frequency of the rectified electrical supply signal.

In the method according to the invention the current limit is set proportional to an instantaneous voltage of the rectified electrical supply signal.

Measuring the charge transport preferably comprises measuring a current from the source of rectified electrical supply signal. As mentioned before the current limit may correspond to a maximum current, an average current during the charging and or an average during a combined duration of said charging and said discharging.

During said releasing of stored electrical energy the load is preferably solely fed by this release of electrical energy whereas during charging, the load is preferably at least partly fed by the source of rectified electrical supply signal.

Figure 5:
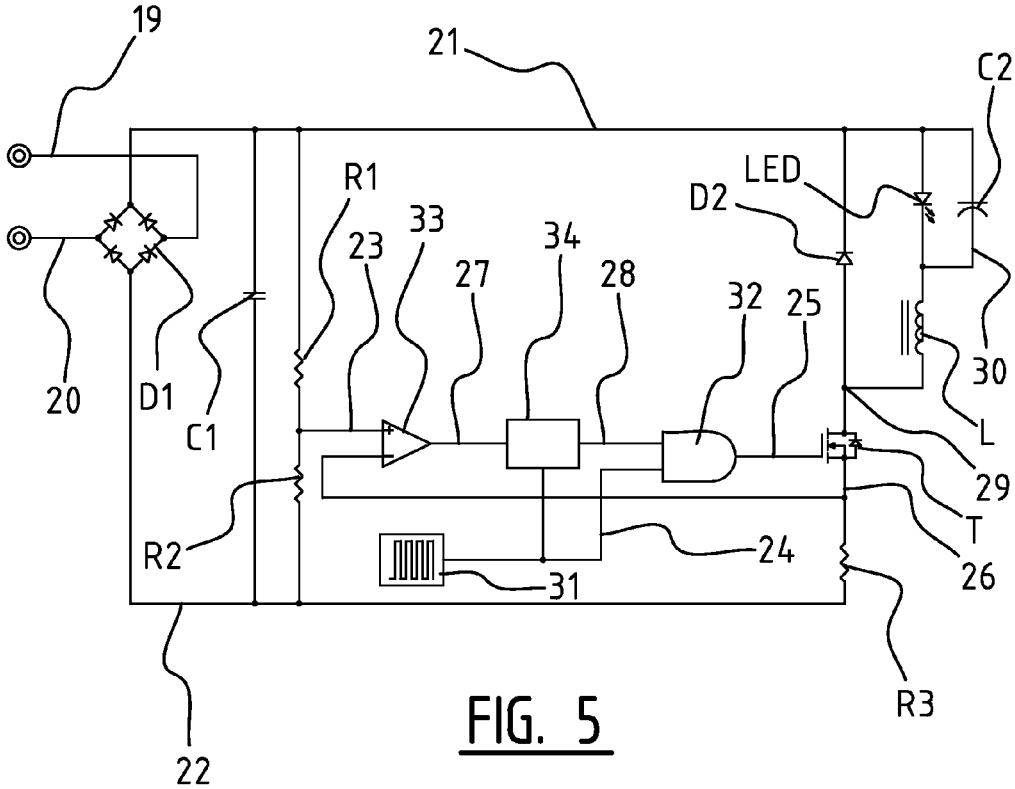
FIG. 5 shows a schematic illustration of a LED lighting system according to the present invention.

FIG. 5 shows a schematic illustration of a LED lighting system according to the present invention. The system comprises a switched-mode power supply or LED driver that is connectable to one or more LEDs, as illustrated. The operation of this system will now be described under reference to FIGS. 6A-6N.

Figure 6A:
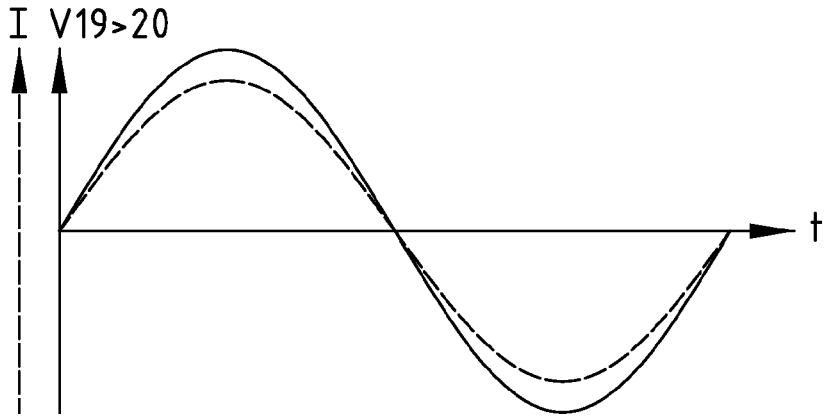
FIGS. 6A-6N illustrate various waveforms corresponding to the embodiment in FIG. 5.
Figure 6B:
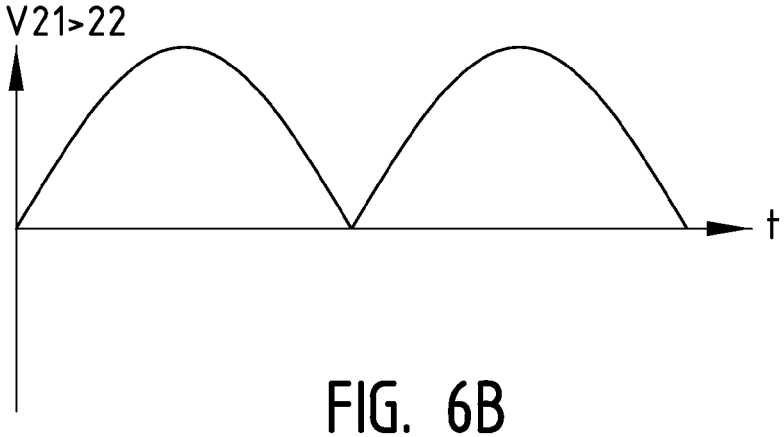
Figure 6C:
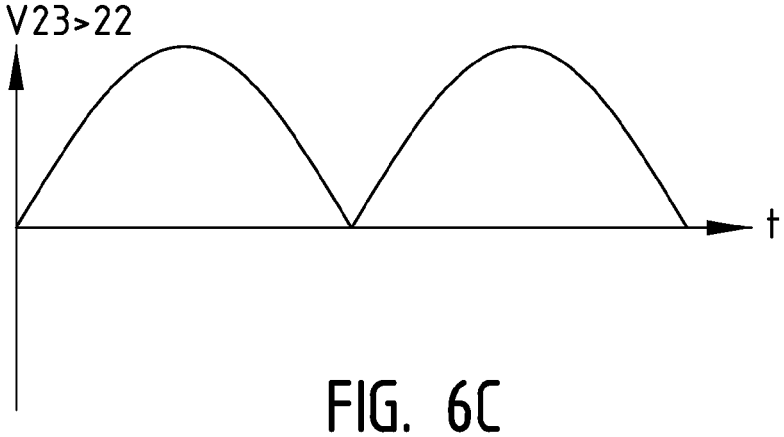
Figure 6D:
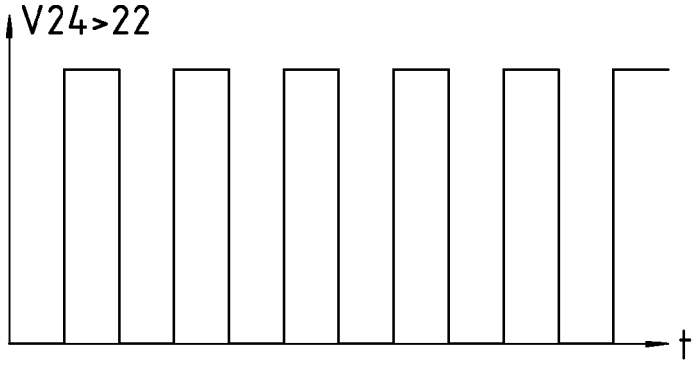

First, at points 19 and 20, alternating voltage from a mains network is offered, see FIG. 6A. In this figure, as well as the remaining figures $V_{x>y}$ denotes the voltage between points x and y illustrated in the figure. The alternating voltage is rectified by rectifier D1, see FIG. 6B. Using a resistive divider comprising resistors R1 and R2, a reference signal is generated which has a linear relationship with the rectified electrical supply signal, see FIG. 6C. An oscillator 31 is provided having a fixed frequency, which is substantially larger than a frequency of the rectified electrical supply signal. The oscillator generates the basis signal for the timing of the driver/power supply. An output of oscillator 31 is shown in FIG. 6D. Some deliberate frequency variations in the frequency of the signal outputted by the oscillator may have beneficial effects on the electromagnetic compatibility properties of the power supply or driver. These effects can be achieved by applying a spectral spreading technique to the currents and voltages in the system. This avoids spectral peaks at specific frequency points.

Figure 6E:
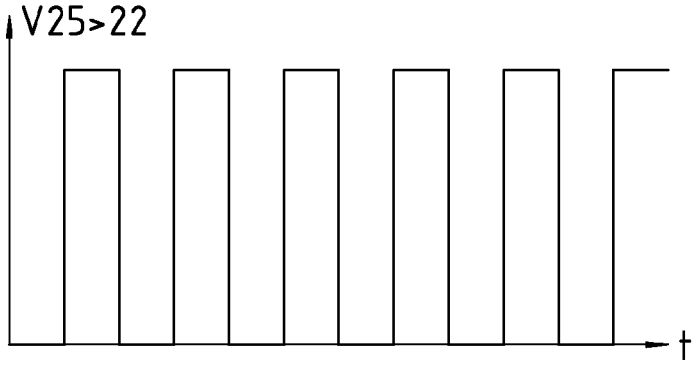

In case no feedback is applied, contrary to what will be described next, a signal will be applied to the switching element T via a logical AND gate 32 which is identical to the output signal of oscillator 31, see FIG. 6E.

The actual feedback, which is an important aspect of the present invention, is possible because the current through switching element T also flows through resistor R3. The voltage drop over this resistor is fed back to a comparator 33, which compares the voltage to the reference signal. As soon as the voltage over R3 exceeds the value of the reference signal, comparator 33 changes output level from high to low. Because the reference signal is linearly proportional to the rectified electrical supply signal, the output of comparator 33 will remain high for a longer period of time for higher values of the rectified electrical supply signal. Consequently, the current $I_{R3}$ through switching element T can achieve a higher value under these conditions.

Figure 6F:
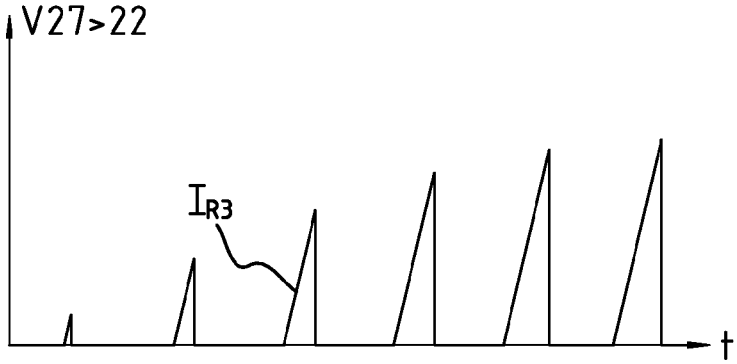

The current magnitude may depend on many factors in the circuit but under most circumstances will display peaks that correspond to a sinusoidal trend, see FIG. 6F.

By decoupling of the current components at the oscillator or switching frequency by C1, the current at the input, points 19 and 20, will display a sinusoidal trend with a frequency of that of the mains network. Furthermore, this trend is virtually in phase with the mains network. The value of C1 influences the phase relationship between voltage and current on the mains network. However, sufficient decoupling can be achieved at high power factor values (>0.9) as indicated in FIG. 6A.

Figure 6G:
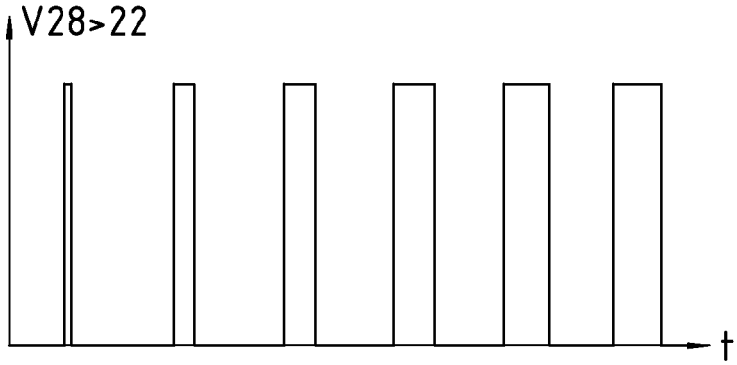

The output signal of comparator 33 is fed to a timing circuit 34. This circuit will drive the output at point 28 low directly after a switch from high to low at the comparator output. Only at a next rising flank of the signal from oscillator 31 timing circuit 34 will be driven again causing the output to attain a high value, see FIG. 6G.

Figure 6H:
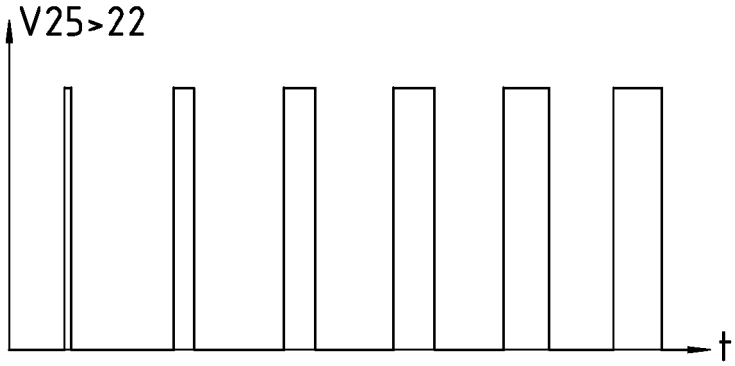

This operation ensures a blocking operation of switching element T as soon as the maximum allowable current through resistor R3 has been achieved. Switching element T is only brought back into a conductive state, and hence the switched-mode power supply in the charging state, at the start of a new cycle of oscillator 31, see FIG. 6H.

Figure 6I:
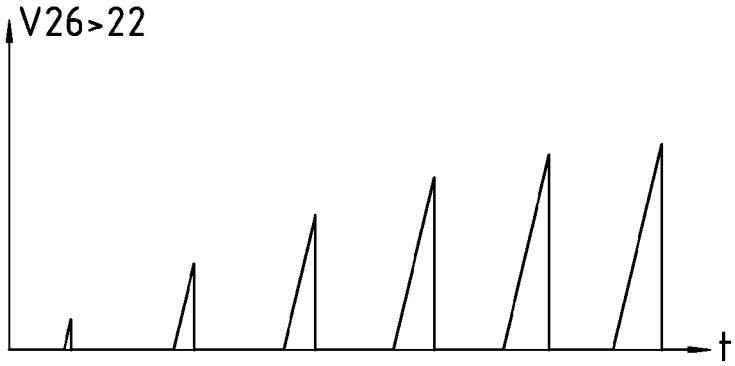
Figure 6J:
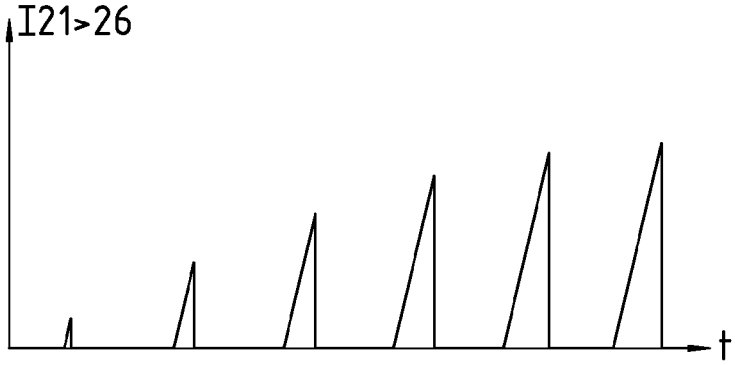

Under influence of oscillator 31 and the feedback in the switched-mode power supply, a current through R3 will result as shown in FIG. 6I. This same trend is visible between points 21 and 26, see FIG. 6J.

Figure 6K:
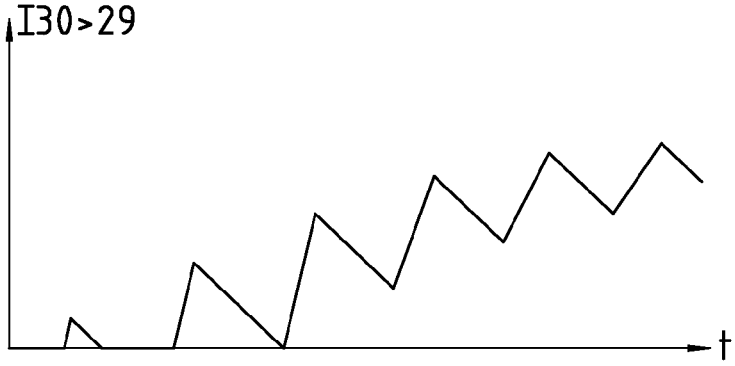

Because during the blocking of switching element T (discharging state), the energy stored in inductor L can be released through diode D2 and be used by the LED(s), the current through inductor L will have a sawtooth shape. The average value thereof has a sinusoidal shape, which is in phase with the mains network, as illustrated in FIG. 6K.

Figure 6L:
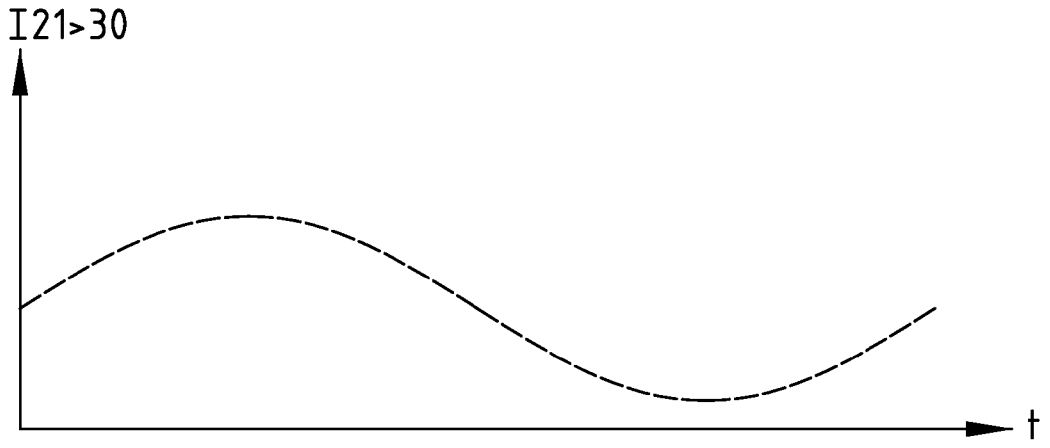

Capacitor C2, placed over the LED(s), causes the current and voltage through and over the LED(s) to even out. The result is shown in FIG. 6L. The capacitance value of the capacitor does not influence the phase relationship at the input of the LED driver/switched-mode power supply considerably, because it is only visible during the charging state.

Figure 6M:
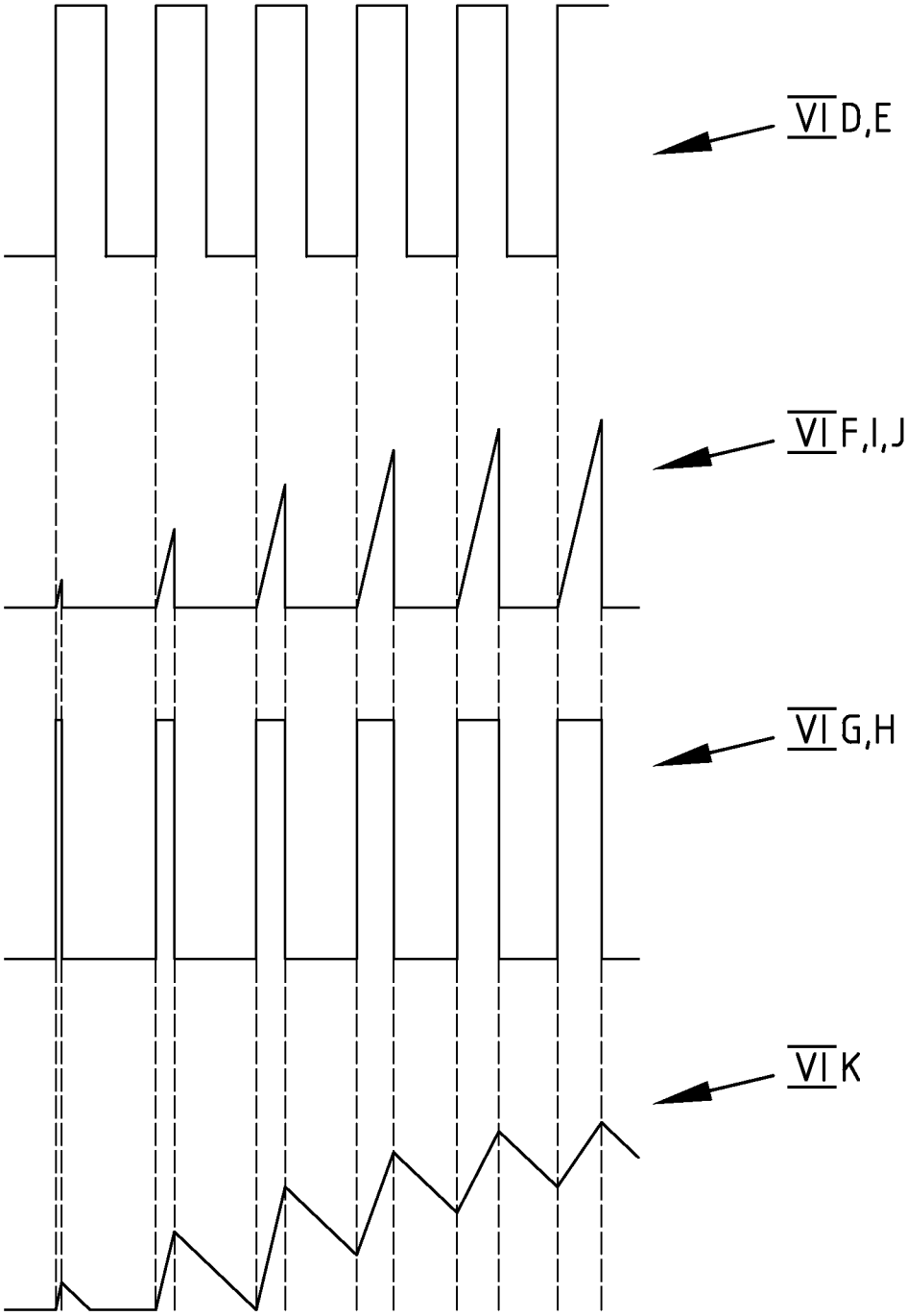

FIG. 6M shows the relationship in time between the various waveforms described so far. In this figure, roman numbers are used to refer to the relevant figures, e.g. VI D refers to FIG. 6D.

Figure 6N:
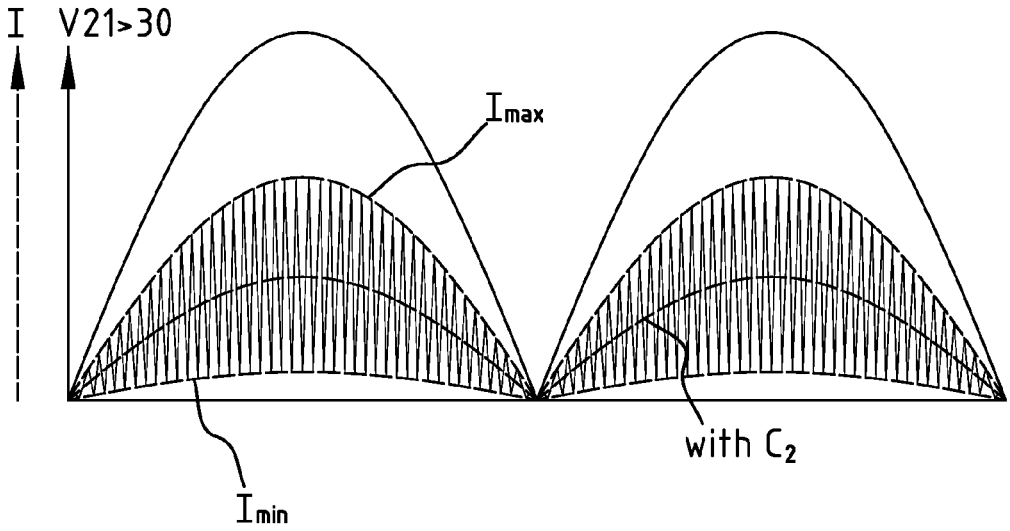

FIG. 6N schematically illustrates the waveform of the current through the LEDs with and without C2. Without C2, the current varies between a maximum Imax and minimum Imin. With C2 the high frequency components are removed. In both cases, the average current shows a sinusoidal trend in phase with and proportional to the voltage outputted by the rectifier. Consequently, the switched-mode power supply according to the invention will display a high power factor.

Figure 7:
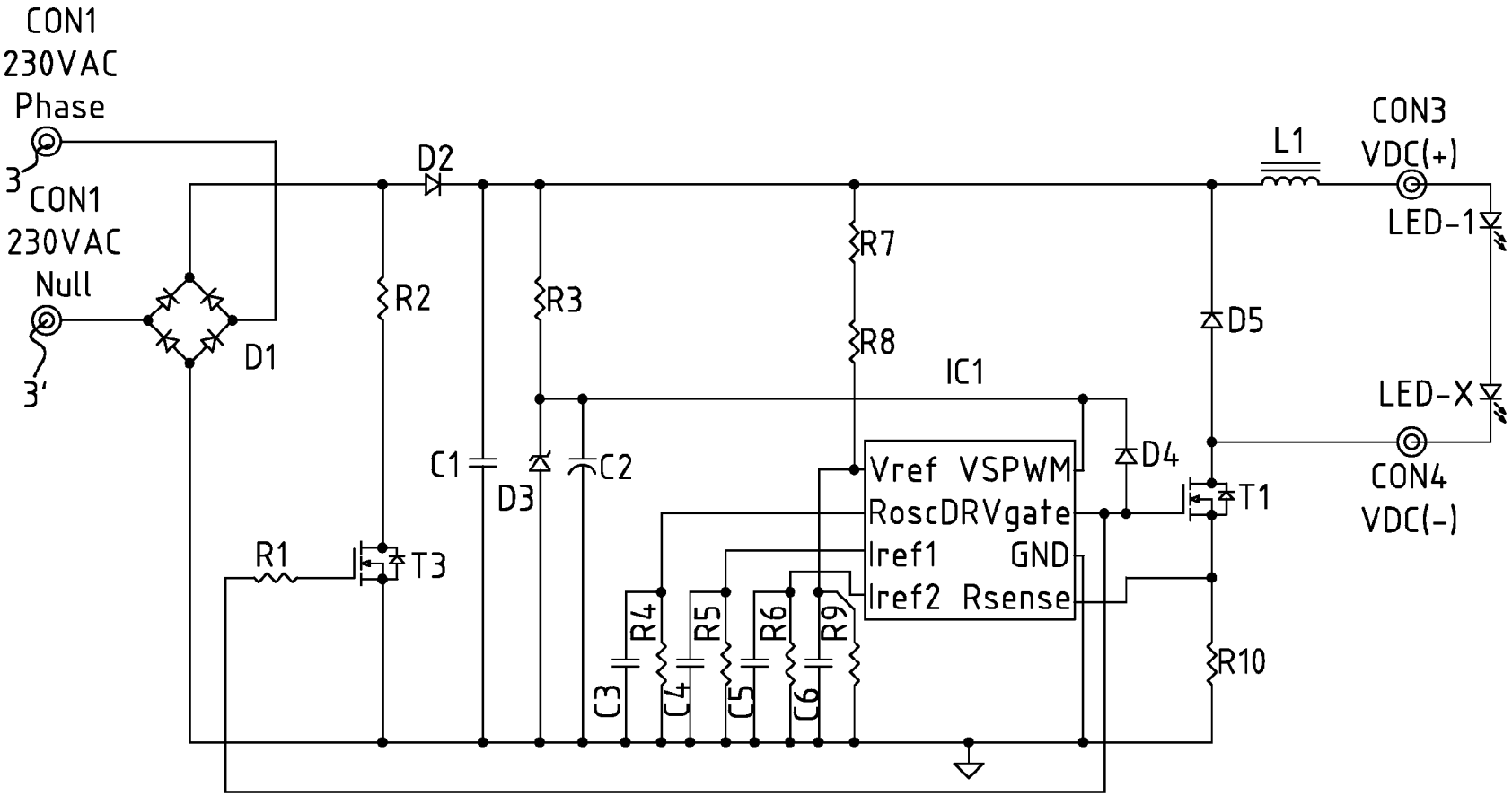
FIGS. 7 and 8 depict other embodiments of the present invention.
Figure 8:
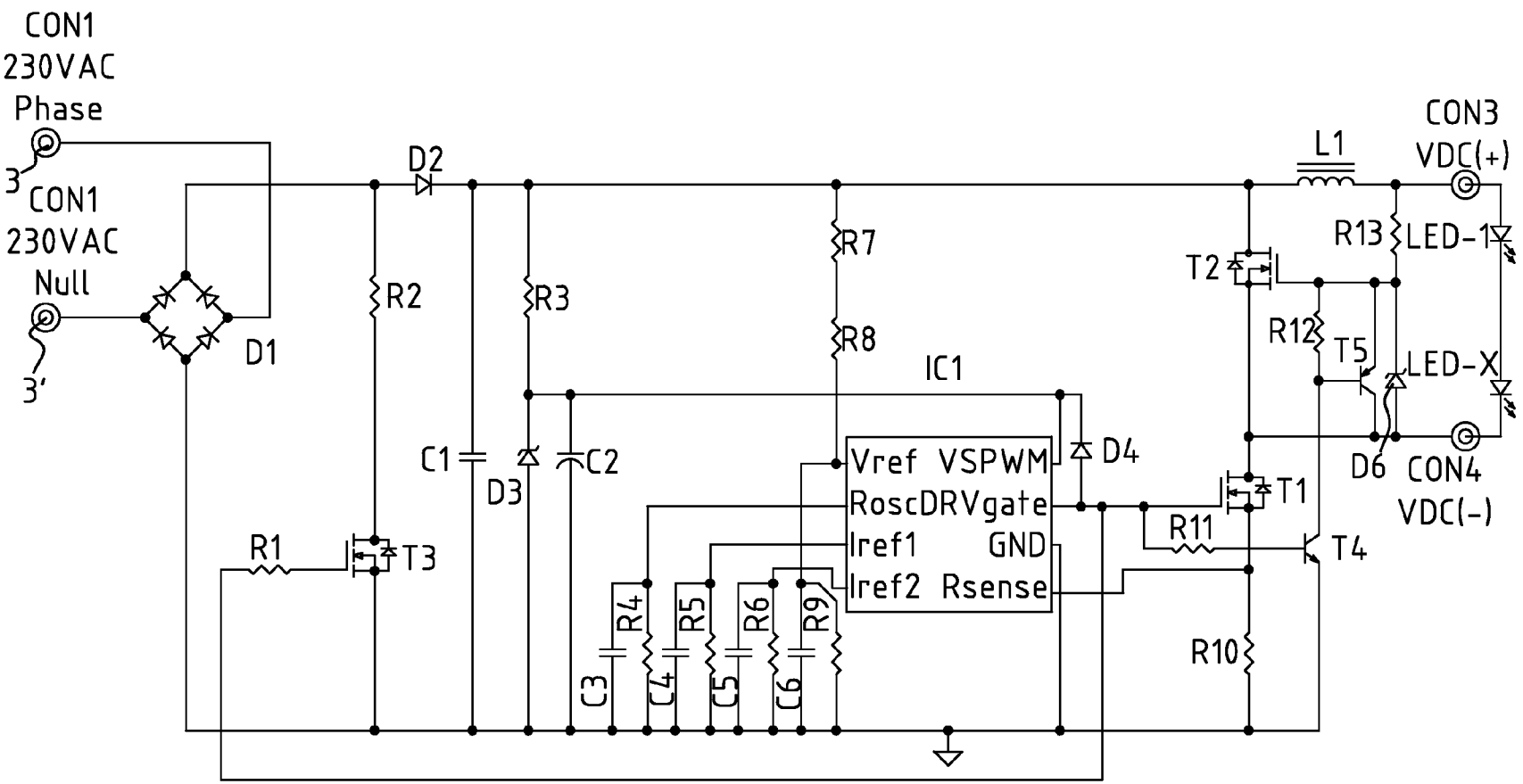

FIGS. 7 and 8 depict other embodiments of the present invention. In FIG. 7 a preferred embodiment of the present invention is shown. According to this embodiment, the LED lighting system comprises a diode bridge-rectifier D1. The rectified signal is fed to inductance L1 which is connected in series to a plurality of LEDs (LED-1 . . . LED-X). A fly-back diode D5 is placed in parallel to this series connection such that the corresponding diodes, e.g. LED-1 and D5, are anti-parallel. At the cathode side of the LED-X, indicated by CON4, the series-parallel combination is connected to n-channel MOSFET T1. Resistor R10 is in series with T1 and is used during the "on" state of T1 to measure the current through LED-1, as will be discussed later.

The gate of T1 is driven by a transistor-driver IC1, e.g. the MLX10803 from Melexis or the HV9910 from Supertex. In the embodiment shown in FIG. 7, the MLX10803 is used and therefore only the relevant pin names of the MLX10803 are shown. Next, the operation of the LED lighting system will be discussed in detail.

As a starting condition it is assumed that T1 is open, e.g. low ohmic. A current will flow through L1, LED-1 . . . LED-X, T1 and R10 to ground. Due to the nature of L1, this current will gradually increase thereby storing magnetic energy in the inductance. The current through LED-1 is sensed using the voltage over R10. This voltage is fed to the Rsense pin of IC1. Once the current has exceeded a certain predetermined limit, which is adjustable using a voltage applied to the Vref pin, the transistor driver switches off T1. Consequently, the inductance will start to release its magnetic energy using a current that will flow through LED-1 . . . LED-x, D5 back to L1.

The maximum current as well as the time that T1 is put in the "off" state can be adjusted using components external to IC1 and/or the voltage applied to pin Vref.

In this embodiment, the Vref pin is connected to resistive divider composed of R7, R8 and R9. Consequently, the maximum current through LED-1 is set proportional to the instantaneous value of the rectified electrical supply signal. As a result, the current drawn by the LED lighting system is proportional to the instantaneous voltage applied to that system, leading to the desired high power factor and low harmonic distortion.

In FIG. 7, Zener diode D3, capacitor C2 and resistor R3 provide a 12V supply voltage for IC1. The external components C4, R5 and C5, R6 connected to Iref1 and Iref2, respectively, can be adjusted to optimize the temperature behavior of the LED lighting system. With components C3, R4 the oscillation frequency of IC1 can be chosen. In addition, diode D4 is used to discharge the gate of T1. More details can be found in the application note of IC1 and a more detailed description is therefore deemed unnecessary.

In addition, the embodiment in FIG. 7 comprises an n-channel MOSFET T3 connected to the gate of T1 by resistor R1. T3 is connected to the rectified electrical supply signal by resistor R2. The purpose of T3 and R2 is to provide ohmic loading of the rectifier such that the LED lighting system can be dimmed using conventional triac-based dimmers. These dimmers usually are activated very quickly but require a minimum amount of current to keep them activated. A problem with LED-based circuits is that the current that is drawn by the system is relatively low compared to for instance incandescent lighting. These systems are therefore difficult to dim especially in the low voltage region of the supply signal. T3 and R2 improve this behavior in that a ohmic load is presented which draws a current when T1 (and T3) is in the "on" state. In general, the duration of the "on" state is much shorter than the duration of the "off" state so that the energy that is lost through R2 is marginal. Due to the fact that the switching frequency of IC1 is much higher (e.g. 30 kHz) than the rectified electrical supply signal (e.g. 120 Hz) and due to the fact that the triac-based dimmers activate quickly but extinguish much more slowly, the dimmer remains activated during a large portion of the cycle of the alternating electrical supply signal.

Diode D2 and capacitor C1 are incorporated to reduce the impact on harmonic distortion by the current pulses caused by R2 and T3.

In FIG. 8, a further development of the circuit from FIG. 7 is depicted. In this embodiment, the fly-back diode D5 is replaced by a n-channel MOSFET T2. The gate of T2 is connected to the gate of T1 by an invertor comprised of PNP transistor T5 and NPN transistor T4. A Zener diode D6 is used to limit the voltage drop over T5. The operation of T2 is opposite to T1, i.e. if T1 is in the "on" state, T2 is in the "off" state and vice versa. If T1 is in the "off" state, the current from L1 flows through T2 instead of the fly-back diode D5. The advantage of using the n-channel MOSFET is that is presents a low ohmic path and does not suffer from the on-voltage of the fly-back diode D5. Consequently, the losses during the "off" state of T1 can be reduced significantly.

It should be obvious to the skilled person that features disclosed in any of the embodiments, e.g. the capacitor placed parallel to the LEDs, can be combined into a new embodiment without deviating from the scope of the present invention.

With the embodiments described above, a power factor can be achieved better than 0.95 combined with a total harmonic distortion better than 15%. The total power efficiency is better than 85%. It is highly surprising that these figures can be obtained with this amount of components. The costs involved in fabrication and maintenance are therefore greatly reduced compared to more complex systems in which the power factor is improved by providing additional complex circuitry. To the applicant's knowledge, these circuits do not employ the principle according to the present invention.

Finally, it should be noted that it is apparent for a skilled person in the art that various modifications and changes can be applied to the embodiments described in conjunction with the present invention without deviation from the scope of the invention as set forth in the appended claims.

For instance, energy could be stored in a non-electrical form in the energy storage. Energy stored must during the discharging state be used to at least partly feed the load. Any energy conversion step prior to this release of energy is not excluded.

Additionally or alternatively, the current drawn from the rectifier will comprise a small component for feeding the circuitry of for instance the switching element controller. Determining the current limit according to the invention allows this current to be taken into account.

Another technology for storing electrical energy to be transferred to a load is the use of a piezoelectric transformer. This device is able to transfer electrical energy by mechanically storing it via two electrodes at the primary side of a crystal, and discharging it into a load via two electrodes at the secondary side. Due to its specific properties, a piezoelectric transformer can be used to design power supplies for a wide range of input- and output voltages at low to high output power, while maintaining a very good power factor, high efficiency and small dimensions. This type of power supply can for instance be used for laptops and desktop computers, LCD television screens and monitors, low voltage illumination and many more. It should be obvious that these applications could also employ the switched-mode power supply described earlier.

The invention claimed is:

1. A switched-mode power supply for providing electrical supply to a load, comprising:

a rectifier having an input and an output, said rectifier being arranged to convert an electrical supply signal provided at its input into a rectified electrical supply signal emerging at its output;

an energy storage for storing electrical energy, said energy storage being connectable to said load;

a controllable switching element connected to the energy storage, wherein the switching element is arranged to switch the switched-mode power supply between a charging state, in which the energy storage is charged by the rectifier via charge transport from the rectifier, and a discharging state, in which the energy storage releases at least part of electrical energy stored therein to the load;

a switching element controller for controlling the switching element, wherein the switching element controller is arranged to control the switching element to switch the switched-mode power supply from the charging state to the discharging state when the charge transport exceeds a current limit;

wherein during operation the switched-mode power supply alternates between the charging state and discharging state at a switching frequency which is substantially higher than a frequency of the rectified electrical supply signal, and wherein the current limit is set proportional to an instantaneous voltage of the rectified electrical supply signal.

2. A switched-mode power supply according to claim 1, wherein the current limit corresponds to one of the group consisting of:

the maximum current during the duration of the charging state;

the average current during the duration of the charging state; and the average current during the combined duration of the charging state and discharge state, wherein the switching element controller is arranged to measure a current corresponding to said charge transport and to determine the average current by integrating the measured current over time and by dividing the integrated current by the relevant duration.

3. A switched-mode power supply according claim 1, wherein the switching element controller is arranged for controlling the switching element to switch the switched-mode power supply from the discharging state to the charging state after a predetermined amount of time after a switch from the charging state to the discharging state and or wherein the combined duration of the charging state and discharging state has a predetermined value.

4. A switched-mode power supply according to claim 1, wherein during the discharging state, the load is solely fed by the release of electrical energy from the energy storage and or wherein during the charging state, the load is at least partly fed by the rectifier, and or wherein charge transport from the rectifier is limited to the charging state.

5. A switched-mode power supply according to claim 1, comprising:

a voltage meter for measuring a voltage proportional to an instantaneous voltage outputted by the rectifier;

a charge transport meter for measuring the charge transport;

a comparator for comparing the measured charge transport to the current limit, wherein the comparator is further arranged for outputting a comparison signal indicative for whether the current limit has been exceeded or not;

wherein said switching element is controllable in dependence of the comparison signal.

6. A switched-mode power supply according to claim 5, wherein during said charging state the charge transport from the rectifier is through the switching element.

7. A switched-mode power supply according to claim 6, wherein the voltage meter comprises a resistive voltage divider connected to the output of the rectifier, and wherein the charge transport meter comprises a resistor connected in series with the switching element, said charge transport meter being arranged to determine a voltage drop over the resistor.

8. A switched-mode power supply according to claim 7, further comprising a holding unit for holding a value of the comparison signal after detection of exceeding the current limit.

9. A switched-mode power supply according to claim 8, comprising an oscillator outputting an oscillation signal having a frequency substantially higher than a frequency of the rectified electrical supply signal, wherein the switching element is arranged to switch the switched-mode power supply to the charging state in dependence of the oscillation signal.

10. A switched-mode power supply according to claim 9, wherein the switching element is controllable to switch the switched-mode power supply to the charging state in dependence of both the held value of the comparison signal and the oscillation signal.

11. A switched-mode power supply according to claim 1, further comprising a filter connected to the rectifier output to reduce injection of high harmonics back into the rectifier output.

12. A switched-mode power supply according to claim 1, wherein the energy storage comprises an inductor, and wherein the inductor is placed in between the rectifier and the switching element, wherein the load is connectable in series with the inductor, said switched-mode power supply further comprising a fly-back diode connected in parallel to the series connection of load and inductor.

13. A switched-mode power supply according to claim 1, wherein the energy storage comprises a primary coil of a transformer and wherein the load is connectable to a secondary coil of the transformer.

14. A switched-mode power supply according to claim 1, wherein the switching element comprises a first transistor.

15. An LED lighting system comprising a light-emitting diode (LED) and a LED driver to electrically drive said LED, wherein the LED driver comprises the switched-mode power supply according to claim 1.

16. An LED lighting system according to claim 15, wherein the energy storage is connected in series with the LED, said series connection of energy storage and LED having a first node and a second node, said LED driver further comprising a fly-back diode placed parallel to the series connection of energy storage and LED, said fly-back diode having its cathode connected to the first node and its anode connected to the second node, wherein the second node is connected to the switching element.

17. An LED lighting system according to claim 15, wherein the energy storage is connected in series with the LED, said series connection of energy storage and LED having a first node and a second node, said LED driver further comprising a second transistor placed parallel to the series connection of energy storage and LED, wherein the second transistor is controllable by the switching element controller such that the first and the second transistor operate in opposite states, and wherein the second node is connected to the first transistor.

18. An LED lighting system according to claim 15, further comprising a third transistor connected to the output of said rectifier, said third transistor placed in series with a resistive load and being controllable by the switching element controller, wherein the third transistor and switching element controller are arranged to provide an internal resistive loading during the charging state.

19. An electronic LED driver for use in a lighting system, wherein the electronic LED driver is arranged as defined in claim 15.

20. A method for electrically driving a load comprising the steps of:

a) providing an energy storage for storing electrical energy;
b) providing a source of rectified electrical supply signal;
c) connecting the load to the energy storage;
d) charging the energy storage from the source of rectified electrical supply signal via charge transport from this source;
e) measuring the charge transport;
f) comparing the charge transport to a current limit;
g) switching from said charging of the energy storage to releasing of stored electrical energy in the energy storage to the load when said current limit is being exceeded;
h) switching from said releasing of stored electrical energy to said charging;
i) repeating steps e)-h), resulting in an alternating behaviour of charging and discharging with a corresponding frequency which is substantially higher than a frequency of the rectified electrical supply signal, said method further comprising setting the current limit proportional to an instantaneous voltage of the rectified electrical supply signal.

21. The method according to claim 20, wherein step e) comprises measuring a current from the source of rectified electrical supply signal, and wherein the current limit corresponds to a maximum current.

22. The method according to claim 20, wherein step e) comprises measuring a current from the source of rectified electrical supply signal, and wherein the current limit corresponds to an average current during said charging.

23. The method according to claim 20, wherein step e) comprises measuring a current from the source of rectified electrical supply signal, and wherein the current limit corresponds to an average current during a combined duration of said charging and said discharging.

24. The method according to claim 20, wherein during said releasing of stored electrical energy the load is solely fed by this release of electrical energy.

25. The method according to claim 20, wherein during said charging the load is at least partly fed by the source of rectified electrical supply signal.

* * * * *